US010214941B2

(12) United States Patent
Hindman

(10) Patent No.: US 10,214,941 B2
(45) Date of Patent: Feb. 26, 2019

(54) DOOR LATCH ACTIVATOR FOR TRAILERS OR TRUCK BODIES

(71) Applicant: Hyundai Translead, San Diego, CA (US)

(72) Inventor: Donald James Hindman, San Diego, CA (US)

(73) Assignee: HYUNDAI TRANSLEAD, San Diego, CA (US)

( * ) Notice: Subject to any disclaimer, the term of this patent is extended or adjusted under 35 U.S.C. 154(b) by 0 days.

(21) Appl. No.: 15/603,250

(22) Filed: May 23, 2017

(65) Prior Publication Data

US 2017/0254117 A1 Sep. 7, 2017

Related U.S. Application Data

(63) Continuation of application No. 14/179,446, filed on Feb. 12, 2014, now Pat. No. 9,657,502.

(51) Int. Cl.

| | |
|---|---|
| ***E05B 51/02*** | (2006.01) |
| ***E05B 81/52*** | (2014.01) |
| ***E05B 83/04*** | (2014.01) |
| ***E05C 3/04*** | (2006.01) |
| *E05B 47/00* | (2006.01) |

(52) U.S. Cl.

CPC ..... *E05B 51/02* (2013.01); *E05B 81/52* (2013.01); *E05B 83/04* (2013.01); *E05C 3/044* (2013.01); *E05B 2047/0053* (2013.01); *Y10S 292/36* (2013.01); *Y10T 292/104* (2015.04); *Y10T 292/1039* (2015.04); *Y10T 292/1041* (2015.04); *Y10T 292/1082* (2015.04)

(58) Field of Classification Search

CPC ..... E05B 51/02; E05B 81/10; E05B 81/52; E05B 83/04; E05B 2047/0053; E05C 3/044; Y10T 292/1082; Y10T 292/1039; Y10T 292/104; Y10T 292/1041; Y10S 292/36

USPC ... 292/194, 200, 240–242, 63, 64, 137, 163, 292/164, 165, 138, 201, 335, DIG. 36; 296/186.3

See application file for complete search history.

(56) References Cited

U.S. PATENT DOCUMENTS

| | | | | |
|---|---|---|---|---|
| 3,199,153 | A | 8/1965 | Weinstein | |
| 3,296,742 | A | 1/1967 | Mortimer | |
| 3,614,147 | A | 10/1971 | Spector | |
| 3,747,275 | A | 7/1973 | May et al. | |
| 4,058,740 | A * | 11/1977 | Dalton | F24D 19/00 307/116 |
| 4,088,354 | A | 5/1978 | Kolendowicz | |
| 4,335,075 | A | 6/1982 | Kackos | |
| 4,762,345 | A | 8/1988 | Stluka et al. | |
| 4,815,773 | A | 3/1989 | Merrell | |

(Continued)

*Primary Examiner* — Christine M Mills

(74) *Attorney, Agent, or Firm* — Procopio, Cory, Hargreaves & Savitch LLP

(57) ABSTRACT

A door latch activator system for a trailer or truck body coupled to a door latch, including: a plunger installed in a path of the door latch; a switch configurable into one of an open or closed position by the plunger; and a pneumatic valve configured to control flow of pressurized air through the pneumatic valve depending on the position of the switch, wherein the plunger is moved toward or away from the roller switch by the door latch operating in the path, which activates the pneumatic valve to control the pressurized air flowing through the pneumatic valve.

5 Claims, 3 Drawing Sheets

(56) References Cited

U.S. PATENT DOCUMENTS

| | | | | |
|---|---|---|---|---|
| 4,978,153 | A | 12/1990 | Hirsch et al. | |
| 5,137,311 | A | 8/1992 | Brackmann | |
| 5,720,333 | A | 2/1998 | Turvey | |
| 5,831,232 | A | 11/1998 | Kushnir et al. | |
| 6,097,306 | A * | 8/2000 | Leon | G07C 1/32 340/10.1 |
| 2003/0000149 | A1 | 1/2003 | Oakley et al. | |
| 2011/0258934 | A1 * | 10/2011 | Gaviglia | E06B 7/2318 49/477.1 |
| 2013/0126106 | A1 | 5/2013 | Hindman | |
| 2015/0068686 | A1 | 3/2015 | Hindman | |

* cited by examiner

DOOR LATCH ACTIVATOR FOR TRAILERS OR TRUCK BODIES

CROSS-REFERENCE TO RELATED APPLICATIONS

This application is a continuation application of co-pending U.S. patent application Ser. No. 14/179,446, filed Feb. 12, 2014, entitled "DOOR LATCH ACTIVATOR FOR TRAILERS OR TRUCK BODIES." The disclosure of the above-referenced application is incorporated herein by reference.

BACKGROUND

Field of the Invention

The present invention relates to an activator, and more specifically, to a door latch activator for trailers or truck bodies.

Background

Recently, the conservation of energy, and corresponding reduction in air pollution for heavy duty diesel powered trucks and refrigerated trailers, has been a major topic of discussion. Many jurisdictions currently require reductions in energy use and air pollution by trucks and trailers idling when being loaded, unloaded, or in standby mode at warehouses, loading docks, stores, and other general parking areas. In connection with these issues, different units within the trailer or truck body may need to be synchronized and/or controlled. In some cases, the trailer or truck body may need to synchronize and/or control units such as a camera unit, interior lighting unit, or pneumatic sealing unit.

SUMMARY

The present invention provides for controlling, synchronizing, and managing units such as a camera unit, interior lighting unit, or pneumatic sealing unit, using air.

In one implementation, a door latch activator system for a trailer or truck body coupled to a door latch is disclosed. The system includes: a plunger installed in a path of the door latch; a switch configurable into one of an open or closed position by the plunger; and a pneumatic valve configured to control flow of pressurized air through the pneumatic valve depending on the position of the switch, wherein the plunger is moved toward or away from the roller switch by the door latch operating in the path, which activates the pneumatic valve to control the pressurized air flowing through the pneumatic valve.

In another implementation, an apparatus for a trailer or truck body is disclosed. The apparatus includes: means for absorbing forces imposed by a door latch, the means for absorbing forces capable of being moved laterally in a path of the door latch; means for switching between closed and open positions by the means for absorbing forces depending on the door latch latching or unlatching; and means for controlling flow of pressurized air depending on a position of the means for switching, wherein the means for absorbing forces is moved toward or away from the means for switching by the door latch operating in the path, which activates the means for controlling to control the pressurized air flowing through the means for controlling.

Other features and advantages of the present invention should be apparent from the present description which illustrates, by way of example, aspects of the invention.

BRIEF DESCRIPTION OF THE DRAWINGS

The details of the present invention, both as to its structure and operation, may be gleaned in part by study of the appended further drawings, in which like reference numerals refer to like parts, and in which.

DETAILED DESCRIPTION

In trailers and truck bodies, air is usually available for use in systems such as a brake system. Certain implementations as disclosed herein provide for controlling, synchronizing, and managing units such as a camera unit, interior lighting unit, or pneumatic sealing unit, using air. In one implementation, the units are activated when a latch for the overhead door (e.g., a roll-up type door) is activated. Since the unlatching of the overhead door is a deliberate action to gain access to the inside of a trailer or truck body for the purpose of accessing the cargo, the latching and unlatching of the door latch can be used to control other units for safety, integrity, and convenience. In a further implementation, a device such as a door latch activator including a plunger-activated pneumatic valve is used to transfer the mechanical action into a "signal" enabling a secondary action including controlling, synchronizing, and managing of the units that provide safety, integrity, and convenience. In this implementation, this device employs a plunger responsible for absorbing the forces imposed by an overhead door latch and converting that force into a trigger to operate a variety of units.

After reading this description it will become apparent how to implement the invention in various implementations and applications. However, although various implementations of the present invention will be described herein, it is understood that these implementations are presented by way of example only, and not limitation. As such, this detailed description of various implementations should not be construed to limit the scope or breadth of the present invention.

Figure 1A:
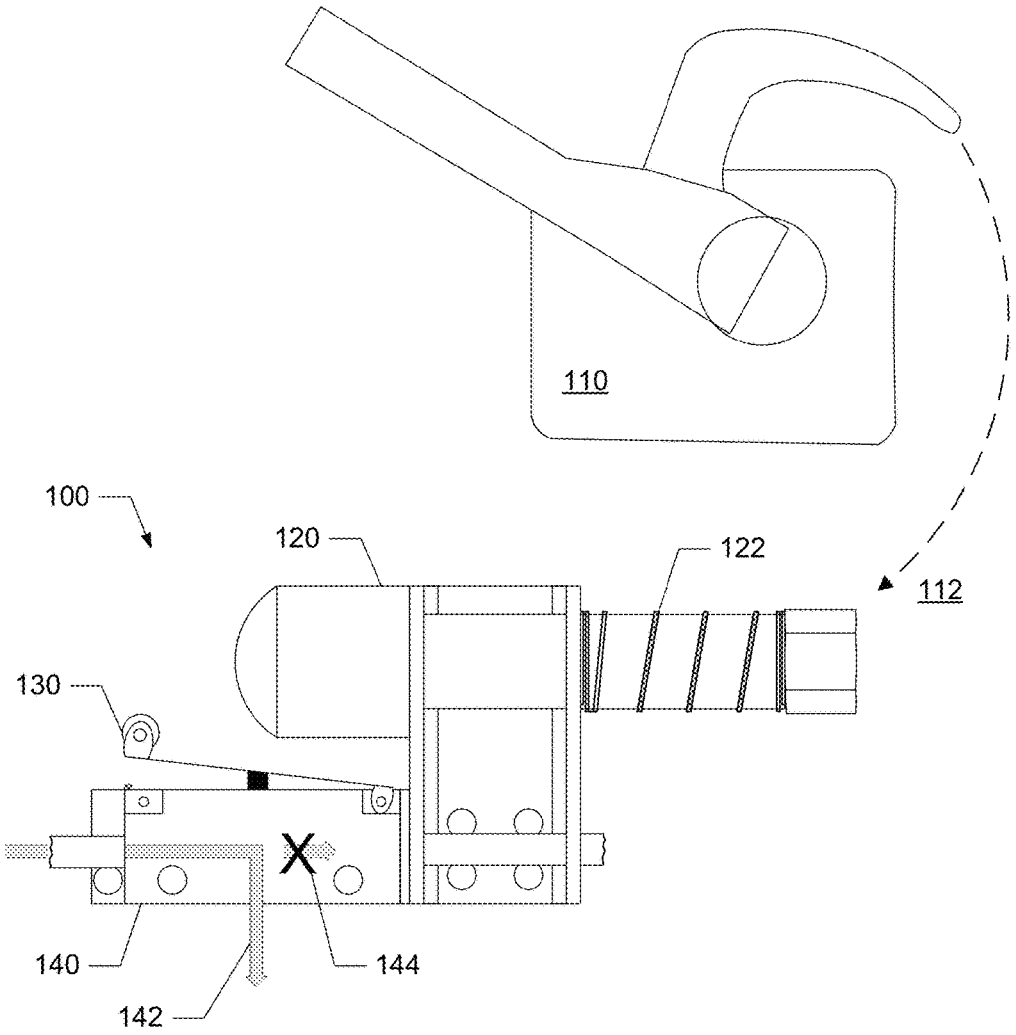
FIG. 1A is a door latch activator for a trailer or truck body in accordance with one implementation of the present invention.

FIG. 1A is a functional diagram of a door latch activator 100 for a trailer or truck body in accordance with one implementation of the present invention. In the illustrated implementation of FIG. 1A, the door latch activator 100 includes a spring-loaded plunger 120, a roller switch 130, and a pneumatic valve 140 which controls the flow of pressurized air through the valve 140 depending on the position of the roller switch 130. As shown, the spring-loaded plunger 120 is installed in the path 112 of the door latch 110. When the door latch 110 is in an unlatched position, as shown in FIG. 1A, the spring 122 wrapped around the plunger 120 causes the plunger 120 to move away from the roller switch 130. Thus, when the door latch 110 is in an unlatched position, the pneumatic valve 140 is deactivated and the air flow 142 through the valve 140 is interrupted, as shown (see 144). Accordingly, in one implementation, with the pneumatic valve 140 deactivated, controls for the camera unit and the interior lighting unit are turned on, while the controls for the pneumatic sealing unit are turned off. In other implementations, the controls may be configured differently.

Figure 1B:
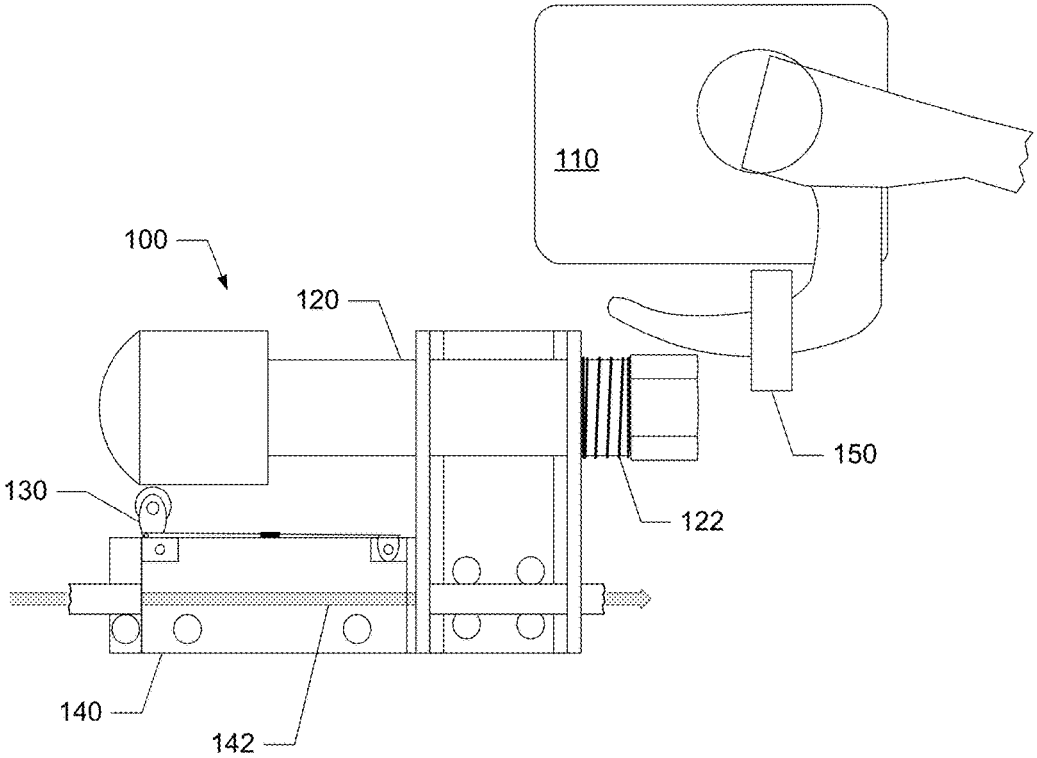
FIG. 1B shows the door latch activator positioned in a latched position in accordance with another implementation of the present invention

FIG. 1B shows the door latch activator 100 positioned in a latched position in accordance with another implementation of the present invention. In the illustrated implementation of FIG. 1B, the door latch 110 is in a latched position with the door latch 110 hooked into a lock 150. Thus, when the door latch 110 is put in a latched position, the plunger 120 is moved toward the roller switch 130 such that the switch 130 makes contact with the pneumatic valve 140 and activates it. Therefore, when the door latch 110 is in a latched position, the pneumatic valve 140 is activated and the air flow 142 through the valve 140 is uninterrupted. The spring 122 acts as a positive force of return for the plunger 120. Accordingly, the illustrated implementation of FIG. 1B shows the plunger-activated pneumatic valve 140 being used to transfer the mechanical action (e.g., latching the door latch 110) into a "signal" enabling a secondary action including synchronizing and controlling of the above-mentioned units such as a camera unit, interior lighting unit, or pneumatic sealing unit. In one implementation, with the pneumatic valve 140 activated, controls for the camera unit and the interior lighting unit are turned off, while the controls for the pneumatic sealing unit are turned on. In other implementations, the controls may be configured differently.

Figure 2:
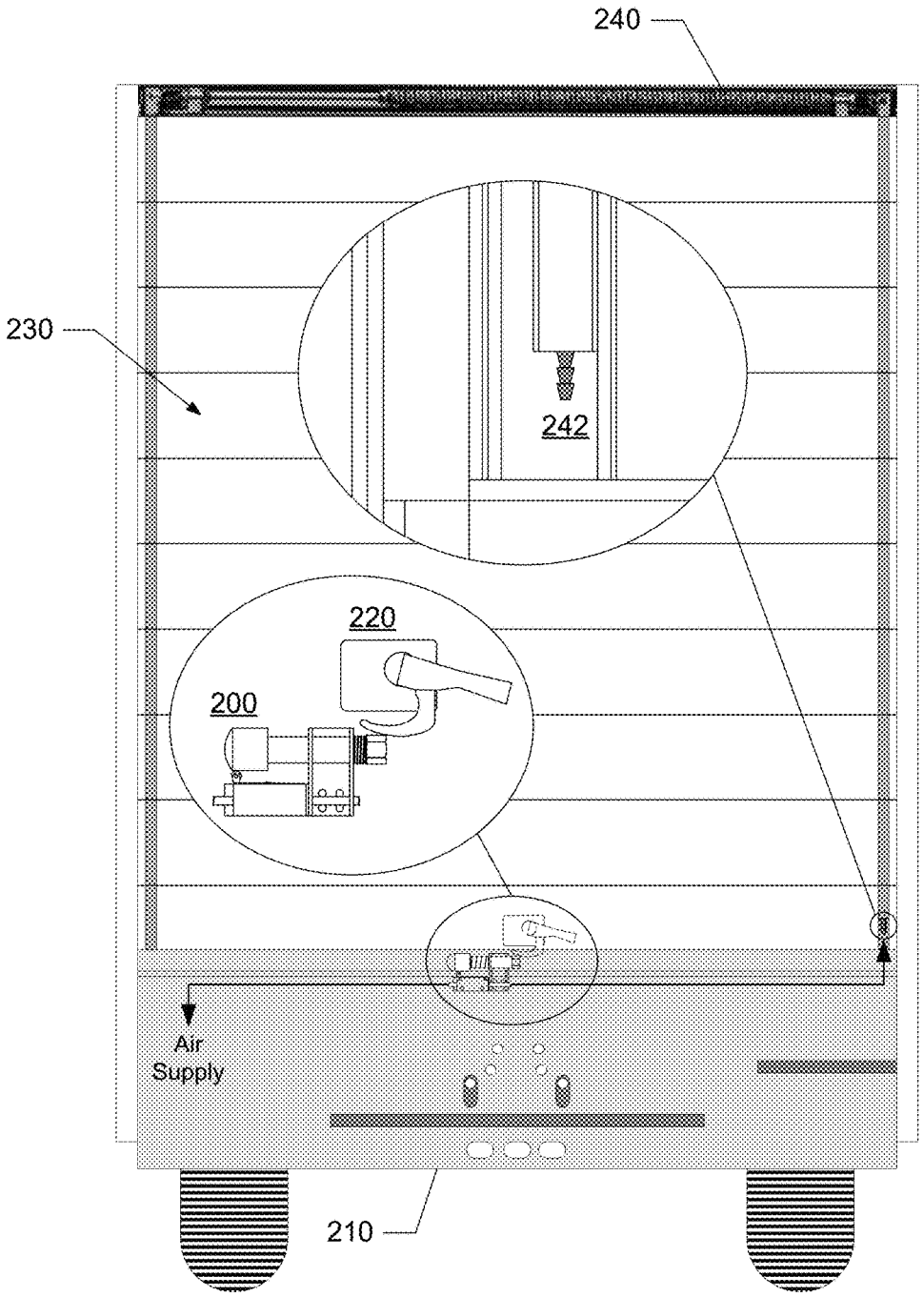
FIG. 2 is a rear view of a truck or trailer body showing the door latch activator installed inside the rear-bottom frame in accordance with one implementation of the present invention.

FIG. 2 is a rear view of a truck or trailer body showing the door latch activator 200 installed inside the rear-bottom frame 210 in accordance with one implementation of the present invention. The door latch activator 200 is installed in proximity of an overhead door latch 220 used to lock or unlock the roll-up door 230. It is designed such that when the door latch 220 is deployed or locked, the plunger is deployed by the door latch 200 pushing it to activate a pneumatic valve. In the illustrated implementation of FIG. 2, the activated pneumatic valve allows the pressurized air from the air supply to pass through to control and operate a pneumatic sealing unit 240 by supplying the pressurized air to the pneumatic sealing unit 240 through a pneumatic gasket 242.

The above description of the disclosed implementations is provided to enable any person skilled in the art to make or use the invention. Various modifications to these implementations will be readily apparent to those skilled in the art, and the generic principles described herein can be applied to other embodiments without departing from the spirit or scope of the invention. For example, while the implementations above focus on an overhead door latch activating the pneumatic valve, other means such as a door handle that opens and closes the door can be used to activate the valve. Further, means other than a pneumatic valve can be used. For example, a mechanical switch can activate the air supply to control various units. Thus, it is to be understood that the description and drawings presented herein represent a presently preferred embodiment of the invention and are therefore representative of the subject matter that is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A door latch activator system for a trailer or truck body coupled to a door latch, the system comprising:

a plunger installed in a path of the door latch;

a spring coupled to the plunger;

a pneumatic valve configured to control flow of pressurized air; and a switch configurable into one of an open or closed position by the plunger, the switch configured to control flow of the pressurized air through the pneumatic valve depending on the position of the switch, wherein the plunger is moved toward the switch by a circular motion of the door latch to engage the switch and to activate the pneumatic valve to allow the pressurized air to flow through the pneumatic valve, wherein the plunger is moved away from the switch by the spring to deactivate the pneumatic valve to interrupt the pressurized air flowing through the pneumatic valve, wherein the flow of the pressurized air through the pneumatic valve is used to control synchronizing and managing units of the trailer or truck body.

2. The system of claim 1, wherein the synchronizing and managing units comprise at least one of an air scaling unit, a camera unit, and an interior lighting unit.

3. The system of claim 1, wherein the synchronizing and managing units comprise units used for safety, integrity, and convenience of the trailer or truck body and a driver of the trailer or truck body.

4. The system of claim 1, wherein the plunger is spring loaded so that the plunger is moved away from the switch when the door latch is unlatched.

5. The system of claim 1, wherein the synchronizing and managing units comprise an air scaling unit connected to an air supply through a pneumatic gasket.

* * * * *